United States Patent [19]

Okada

[11] Patent Number: 4,821,863

[45] Date of Patent: Apr. 18, 1989

[54] TOKEN FEED APPARATUS FOR SLOT MACHINES

[75] Inventor: Kazuo Okada, Tokyo, Japan

[73] Assignee: Kabushiki Kaisha Universal, Oyama, Japan

[21] Appl. No.: 119,216

[22] Filed: Nov. 6, 1987

Related U.S. Application Data

[63] Continuation of Ser. No. 886,096, Jul. 16, 1986, abandoned.

[30] Foreign Application Priority Data

Jul. 16, 1985 [JP] Japan ..... 60-107563

[51] Int. Cl.[4] ..... G07F 1/04

[52] U.S. Cl. ..... 194/344; 194/350

[58] Field of Search ..... 194/344, 346, 350, 338; 232/15, 16; 273/138 A, 138 R

[56] References Cited

U.S. PATENT DOCUMENTS

| | | | |
|---|---|---|---|
| 812,327 | 2/1906 | Cranner | 194/344 X |
| 4,342,384 | 8/1982 | Fukase et al. | 273/138 R |

FOREIGN PATENT DOCUMENTS

| | | | |
|---|---|---|---|
| 2535962 | 2/1977 | Fed. Rep. of Germany | 194/338 |
| 325271 | 2/1930 | United Kingdom | 194/338 |
| 511075 | 8/1939 | United Kingdom | 232/15 |
| 992911 | 5/1965 | United Kingdom | 194/346 |
| 2126395 | 3/1984 | United Kingdom | 194/346 |

*Primary Examiner*—F. J. Bartuska

*Attorney, Agent, or Firm*—Young & Thompson

[57] ABSTRACT

A token feed apparatus is attached to a token discharge port formed on a rear surface of a front door on the main body of a slot machine. The token feed apparatus has a bottom plate extending downwardly toward a token collection bucket and a side plate projecting upwardly from one side of the bottom plate. A token discharged from the token discharge port rolls down the token feed apparatus and is projected to the inner side of the token collection bucket due to the momentum of its rolling motion. The bucket thus fills from rear to front; and an overflow chute at the front of the bucket feeds overflowing tokens to an overflow bucket. A sufficient supply of tokens is thus maintained for the feed of a pay-out device beneath the bucket, at the same time that uncontrolled overflow of coins into the interior of the machine is avoided.

4 Claims, 4 Drawing Sheets

TOKEN FEED APPARATUS FOR SLOT MACHINES

This application is a continuation of application Ser. No. 886,096, filed 7/16/86, now abandoned.

BACKGROUND OF THE INVENTION

This invention relates, in general, to an improvement of a slot machine and more particularly to a token feed apparatus employed in a slot machine for feeding tokens inserted into the slot machine prior to the start of a game, into a token collection basket.

It is a general practice when playing a slot machine game that a player inserts several tokens or coins (hereinafter referred to as "tokens") into a slot formed on a front door of the slot machine prior to the start of a game. Such inserted tokens are collected in a token collection bucket within a main body of the slot machine, which bucket is disposed behind the rear surface of the front door, and are thereafter fed into a hopper device, i.e., a token pay-out device known per se. When the player wins a prize, the token pay-out device is actuated to pay out a predetermined number of tokens from the tokens that have previously been fed into the token collection bucket, according to the value of the prize.

However, since conventional slot machines are constituted such that the tokens inserted into the inlet port simply fall into the token collection bucket from the rear surface of the front door, the tokens accumulate in the front side, i.e., the side near to the front door, of the token collection bucket. This has the crucial disadvantage or drawback that even though there may not be many coins inside the token collection bucket, the tokens are apt to overflow from the front side of the token collection bucket.

In order to eliminate the above-mentioned disadvantage, there has been proposed another slot machine, wherein an overflow chute is attached to the front side of a token collection bucket and overflowing tokens are collected in a separately provided overflow bucket. However, in this case, there is still the risk that overflow may take place before a sufficient number of tokens has accumulated inside the token collection bucket. In that latter case, if a player repeatedly wins large prizes which pay large numbers of tokens, it may happen that in spite of a sufficient accumulation of tokens in the overflow bucket, there will be a shortage of tokens available to be paid out.

The present invention seeks to remedy the above-mentioned circumstance.

SUMMARY OF THE INVENTION

It is therefore a general object of the present invention to provide a token feed apparatus of a slot machine, wherein a sufficient number of tokens to be used for pay-out are always maintained in a token collection bucket disposed in a main body of a slot machine in order to effect an accurate payment.

A specific object of the present invention is to provide a token feed apparatus of a slot machine, wherein a bottom plate is provided in such a manner as to extend downwardly at an incline so that tokens discharged from a token discharge port roll down on the bottom plate and are accumulated within a token collection bucket at its inner side first.

In order to achieve the above objects, a token discharge port formed on a rear surface of a front door is connected with a token feed apparatus formed of a bottom plate for receiving the outer periphery of a token and a side plate for slidingly supportingly contacting either a front or a rear face of the token. Since this token feed apparatus allows a token to roll down in its upright posture and flow into a token collection bucket, the token can easily arrive at an inner side of the token collection bucket. Since the employment of this kind of token feed apparatus serves to impart kinetic energy to the token itself due to its rolling motion, the feed apparatus itself is not required to be extended to be long enough to reach the inner side of the token collection bucket. As a result, the feed apparatus will not be an obstacle to the front door being opened and shut.

The bottom plate and the side plate are not necessarily plate-like members. Alternatively, they may be rail-like members as long as they can guide a token to roll down by supporting the outer periphery and either a front or a rear face of the token.

BRIEF DESCRIPTION OF THE DRAWINGS

The above and other objects, features and advantages of the present invention will become apparent to those skilled in the art from the following detailed description of the present invention, when taken in conjunction with the accompanying drawings, wherein.

DETAILED DESCRIPTION OF THE INVENTION

Figure 5:
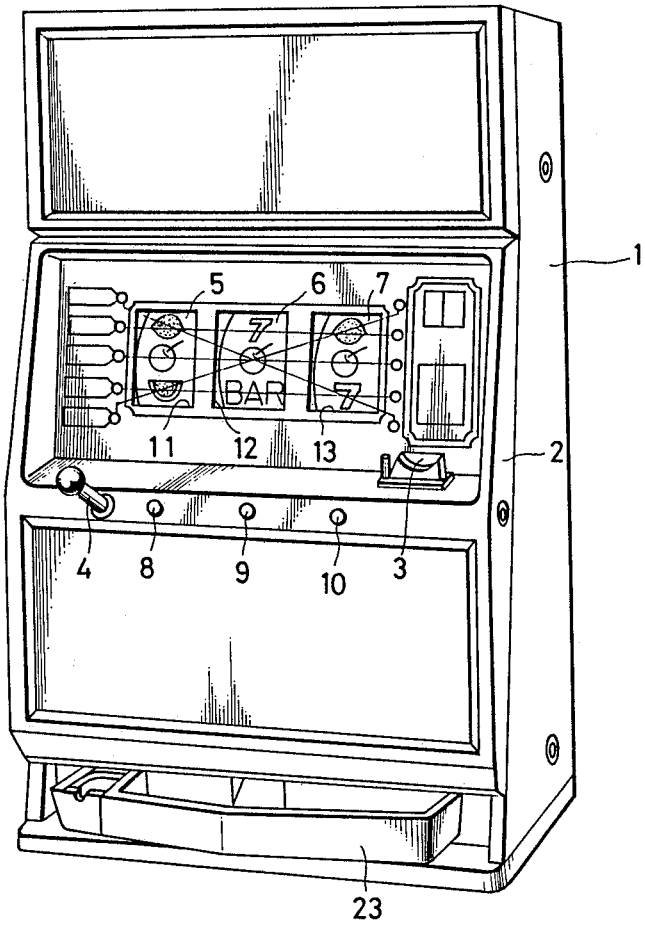
FIG. 5 is a front perspective view of the outside of a slot machine incorporating the present invention.

For an understanding of a slot machine incorporating a token feed apparatus according to the present invention, reference is had to FIG. 5 which shows a perspective view of the slot machine. As will there be seen, a main body 1 has a front door 2. When a token is inserted into the slot machine through a token slot 3 on the front door 2 and a start lever 4 is pulled, reels 5 through 7 are rotated to start a game.

The respective reels 5 through 7 are stopped if corresponding stop buttons 8 through 10 are pushed at desired time intervals, whereupon symbols on the respective reels 5 through 7 appear in display windows 11 through 13. If the displayed combination of symbols wins a prize, a predetermined number of tokens corresponding to the value of the prize are paid out into a receiving tray 23.

Figure 1:
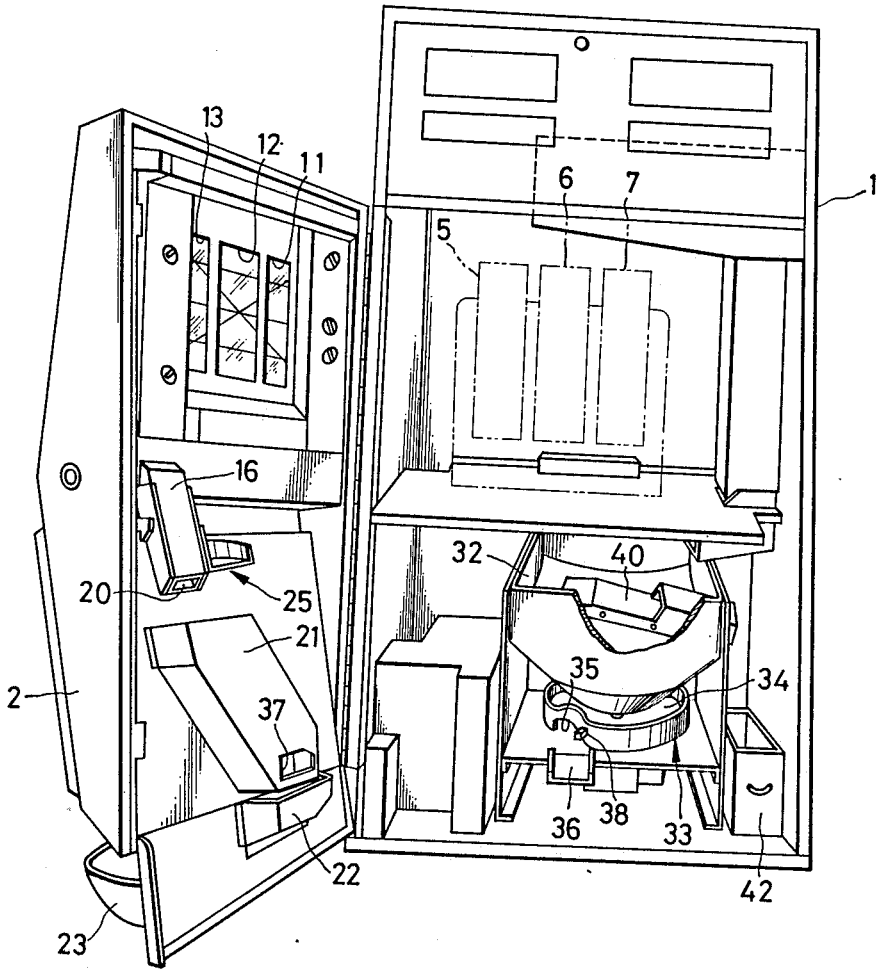
FIG. 1 is a perspective view of a slot machine incorporating the present invention and with its front door open.
Figure 2:
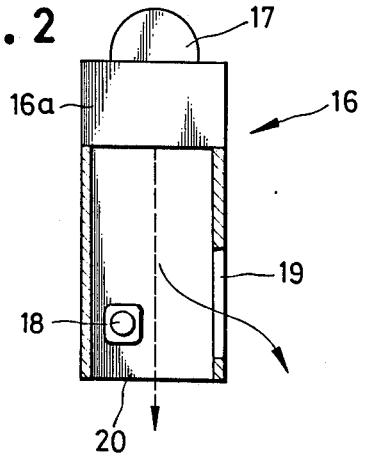
FIG. 2 is a schematic view showing one example of a token selector to be used in the present invention.

As can be seen in FIG. 1, which shows the slot machine with the front door 2 open, a token inserted into the token inlet slot 3 is fed to a token selector 16. The token selector 16 has a detection portion **16*a* as schematically shown in FIG. 2. The token selector 16 photo-electrically detects the size of a token 17 inserted into the token inlet slot 3. If the selector 16 determines that the inserted token 17 is genuine, the selector 16 actuates, for example, a solenoid to cause a pin 18 to project into the path along which the token falls, as shown by broken lines. Due to the projection of the pin 18, a genuine token is discharged from an outlet port 19 as shown by the solid arrow in FIG. 2. Since the pin 18 is not projected when a token is found to be false, it is discharged from an outlet port 20. The false token discharged from this outlet port 20 is ejected onto the receiving tray 23 through a trough 21 and a chute 22**.

Figure 3:
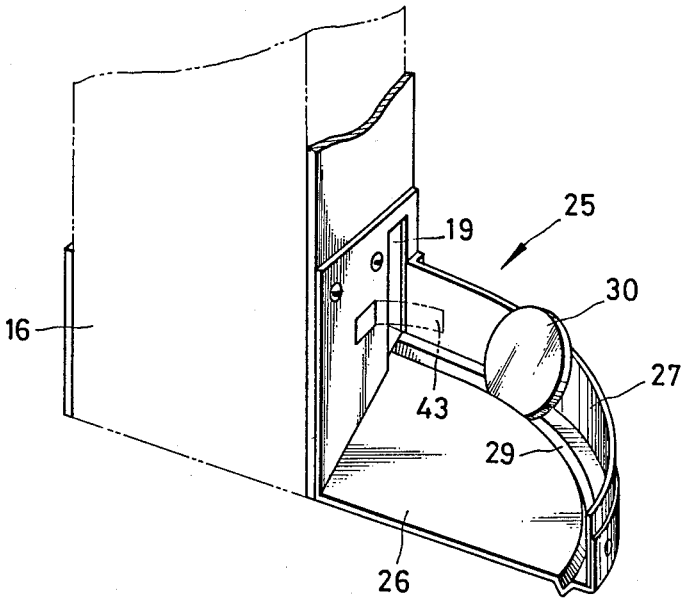
FIG. 3 is a perspective view showing one example of a guide plate to be used in the present invention.

As shown in FIG. 3, the outlet port 19 of the token selector 16 is connected with a guide plate 25. The guide plate 25 comprises a bottom plate 26 inclined downwardly toward the viewer in the figure and a side plate 27 fixedly attached to this bottom plate 26. The outer periphery of the bottom plate 26 is formed in a generally arcuate shape. The bottom plate 26 is formed with a concave groove 29 along the outer periphery thereof. A token 30 discharged from the outlet port 19 is guided in the concave groove 29 along its outer periphery and rolls down on the guide plate 25 while slidingly contacting the side plate 27 at either its front or its rear face. The guide plate 25 may be formed with the bottom plate 26 and the side plate 27 integrally molded by using a resin material, etc.

Tokens which flow down from the guide plate 25 are accumulated in a bucket 32 (see FIG. 1) lower than the guide plate 25. At the bottom of the bucket 32, a token pay-out device 33 is provided. The token pay-out device 33 includes a rotary disc 34 driven by a motor (not shown). When a player wins a prize during a game, the rotary disc 34 is driven by the motor. As a result, a predetermined number of tokens according to value of the prize are fed out from a discharge port 35 through a chute 36 and paid out into the receiving tray 23 through an opening 37 formed in trough 21. Reference numeral 38 denotes a photosensor adapted to count the number of paid-out tokens.

Within the bucket 32, an overflow chute 40 is disposed. In the case that tokens are fed into the bucket 32 via the guide plate 25 when the bucket 32 is already full of tokens, the overflowing tokens are fed to the overflow bucket 42 through the overflow chute 40. Accordingly, it will never occur that tokens overflow from the bucket 32 into the main body 1.

Figure 4:
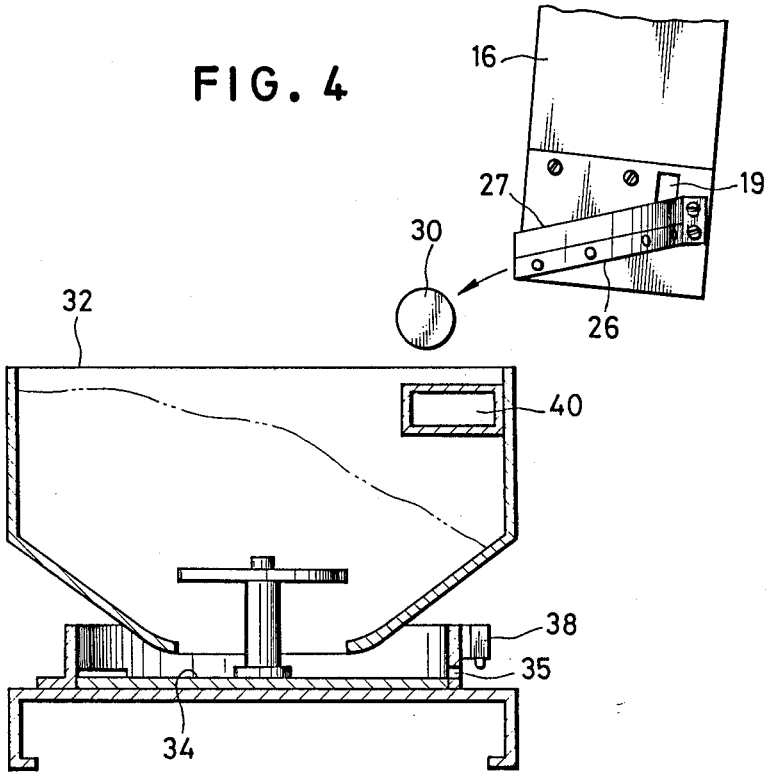
FIG. 4 is an illustration for explaining a function of the present invention.

The guide plate 25, as shown in FIG. 4, is disposed above the overflow chute 40. However, as already described, the token 30 rolling down the guide plate 25 overshoots the overflow chute 40 due to the momentum of its rolling motion and is fed into the inner side of the bucket 32. As shown by chain-dotted lines in the illustration, even though tokens accumulate in the bucket to some extent, the token is directed to the inner side of the bucket 32. As a result, within the bucket 32, tokens 30 accumulate on its inner side first. When tokens have accumulated at the inner side of the bucket 32 and a high heap of tokens is formed there, further tokens 30 cannot be added to the inner side of the bucket 32 and so being to accumulate on the outer side of the bucket 32.

When a fairly large number of tokens has accumulated on the outer side of the bucket 32, subsequent arriving coins overflow into the overflow chute 40 and are fed thence into the overflow bucket 42. In this way, tokens never accumulate only on the outer side of the bucket as in conventional slot machines.

An attitude regulation plate 43 may also be employed, as shown in FIG. 3, to ensure that the tokens will be upright and thus will roll. Moreover, if the attitude regulation plate 43 is provided, the concave groove 29 may be omitted.

As described in the foregoing, according to the token feed apparatus of the present invention, a token having the momentum of its rolling motion is fed from a token discharge port formed on the rear surface of a front door. Accordingly, tokens accumulate beginning from the inner side of a token collection bucket. Accordingly, it will never occur that tokens accumulate only at the outer side of the token collection bucket and overflow from the bucket into the interior of the machine. Furthermore, in the case that an overflow chute is additionally employed at the outer side of the token collection bucket, tokens overflow into the overflow chute only after tokens have accumulated first at the inner and then at the outer side of the bucket. Thus, best use is made of the overflow chute.

Having thus described the preferred embodiment of the present invention, it should be understood that numerous structural modifications and adaptations may be resorted to without departing from the spirit of the present invention.

What is claimed is:

1. In a slot machine comprising a main body, a front door attached to a front part of the main body, the front door having a token inlet port into which tokens are inserted edgewise parallel to said front door and on its rear surface a token discharge port adapted to discharge a token inserted into the token inlet port prior to the start of a game, a token collection bucket in said main body for collecting tokens discharged from said token discharge port, and a token pay-out device connected to said token collection bucket, the improvement comprising:

a token feed apparatus attached to said token discharge port remote from said token collection bucket, said token feed apparatus having a bottom plate extending downwardly at an incline from said token discharge port, said bottom plate terminating in a free end directed rearwardly of said machine toward a rear portion of said token collection bucket and adapted to support the outer periphery of a token discharged from said token discharge portion, a side plate projecting upwardly from one side of said bottom plate and curved about the periphery thereof rearwardly away from said front door so that a token sliding down along said side plate will be reoriented from a position parallel to said front door to a position substantially perpendicular to said front door, said side plate and bottom plate supporting the token upright and allowing the token to roll down on its outer periphery into said token collection bucket and be propelled by its own momentum edgewise rearwardly toward said rear portion of said bucket, and means for regulating the shape of the rolling path of the token along said bottom plate, said regulating means including a groove formed in said bottom plate.

2. A token feed apparatus of a slot machine according to claim 1, and a token attitude regulation plate extending in generally parallel relation with said side plate.

3. A token feed apparatus of a slot machine according to claim 1, wherein said bottom plate and said side plate are integrally molded.

4. A token feed apparatus of a slot machine according to claim 1, and a token selector connected to said token inlet port to separate false tokens from genuine tokens and to discharge only genuine tokens through said token discharge port.

* * * * *